United States Patent [19]

Pedersen

[11] 4,246,707

[45] Jan. 27, 1981

[54] CONVERTIBLE OVERSHOES

[76] Inventor: Frank Pedersen, P.O. Box 517, Mays Landing, N.J. 08330

[21] Appl. No.: 134,293

[22] Filed: Mar. 27, 1980

[51] Int. Cl.[3] ..... A43B 3/24; A43B 1/00; A43B 13/38; A43B 23/28

[52] U.S. Cl. ..... 36/100; 36/7.3; 36/59 R; 36/44

[58] Field of Search ..... 36/100, 101, 7.3, 4, 36/59 R, 44

[56] References Cited

U.S. PATENT DOCUMENTS 1,012,245 12/1911 Chase ..... 36/11.5

2,409,813 10/1946 Timson ..... 36/100

2,901,840 9/1959 Ferguson ..... 36/100

FOREIGN PATENT DOCUMENTS 1119287 6/1956 France ..... 36/100

*Primary Examiner*—Patrick D. Lawson

*Attorney, Agent, or Firm*—Thomas A. Lennox

[57] ABSTRACT

A reversible shoe boot is provided with one sole having normal slip resistance and when turned inside out the second sole surface with ice slip resistance with a semi-rigid inner sole protecting the feet and the slip resistance surface.

5 Claims, 6 Drawing Figures

CONVERTIBLE OVERSHOES

BACKGROUND OF THE INVENTION

This invention relates to the field of rubber footwear typically molded of natural or synthetic rubber with a significant degree of resilience. By the term "rubber footwear" throughout this disclosure, it is intended to include overshoes, rubbers, boots and the like which are typically of a relatively thin wall construction held on the shoe or boot by the elasticity of being stretched over the regular footwear. This type of footwear such as those manufactured under the trademark "TOTES" has the advantage of being light in weight and capable of being easily stored and carried in small pouches for ready unexpected use. This elasticized footwear also has the advantage that it stays firmly on the shoe despite the conditions. On the other hand, this type of boot must be very carefully constructed of fine materials or the service life is extremely short. The rubber material must be truly elastic or else the stretching over the boot will cause a rip or tear after only a short period of use. The rubber used in these footwear provides only moderate slip resistance particularly on ice.

Various types of abrasion materials have been used to aid in walking on ice. These include special cleats that may be strapped to the feet. It is certainly well known that cleats in rubber tires provide the utmost in ice driving safety. However, the use of abrasive materials such as stone or steel cleats wear out, become rounded and loose their effectiveness very quickly if used on road and sidewalk surfaces. The abrasive characteristics of a concrete sidewalk or stone filled asphalt are high. Other abrasive surfaces ground against the concrete or asphalt quickly wear out by rounding the sharp edges or dislodging the abrasive particulate secured to the surface.

In U.S. Pat. No. 1,634,540 to H. C. Harrison he describes rubber footwear that may be turned inside out and worn with either side showing varying colors. A. G. Timson, in U.S. Pat. No. 2,409,813 describes a reversible shoe again to covert the shoe to a combination of colors. In U.S. Pat. No. 2,901,840, M. P. Ferguson describes a convertible snow boot and over boot with a stiffening insole into which a platform sole section can be added.

None of the above articles nor any of the prior boots described above attain the following objects and other objects that will be clear from a complete reading of the disclosure.

It is an object of this invention to provide convertible rubber footwear which may be easily stored but yet will provide slip resistance not only on wet surfaces but also on icy surfaces.

It is an additional object of this invention to provide safe rubber footwear with means to protect the ice gripping surface.

It is a further object of this invention to provide a surface with high resistance to slipping on ice with means of protecting that surface when the footwear is used on equally abrasive surfaces.

An additional object of this invention is to provide rubber footwear which may be used on both ice and wet surfaces with increased durability on both anti-slip characteristics.

It is a further object of this invention to provide rubber footwear that protects the shoe on which the footwear is worn from both the elements and from excessive wear.

The above objects have been attained and the deficiencies of the prior art have been satisfied by my invention hereinafter described.

SUMMARY OF THE INVENTION

My invention is convertible rubber footwear that includes a reversible shoe boot with a sole portion having two surfaces. Either of these two surfaces may in the alternative be on the outside against the ground under the sole of the shoe depending upon which side the boot is used. The shoe boot turned inside out forms essentially the same shape. The first surface is equipped with abrasive materials imbedded in the rubber. These abrasive materials are effective to essentially prevent sliding or slipping on ice. The second surface is provided with the normal anti-slip surface primarily for wet surfaces. This normal surface may include patterned rubber cleats or voids in the rubber to provide extra gripping on wet surfaces. An inner sole having a shape to fit inside the shoe boot over the sole surface then inside, with an upper surface of a semi-rigid material capable of holding the interior shape of the sole and a lower surface of a soft material that will not cause deterioration of the abrasive materials.

DESCRIPTION OF PREFERRED EMBODIMENTS

Figure 1:
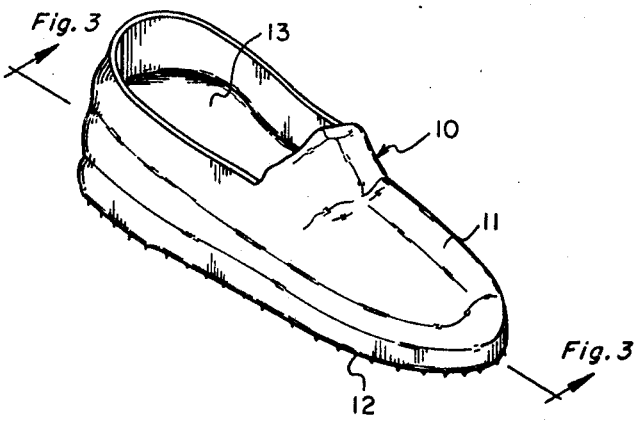
FIG. 1 is a perspective view of the convertible rubber footwear of this invention.
Figure 2:
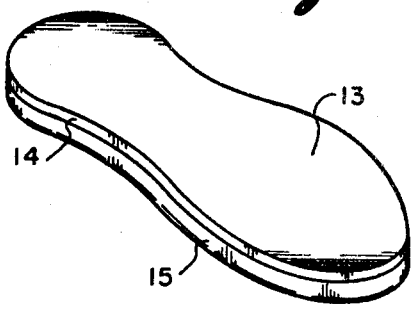
FIG. 2 is a perspective view of the inner sole removed from the footwear illustrated in FIG. 1.
Figure 3:
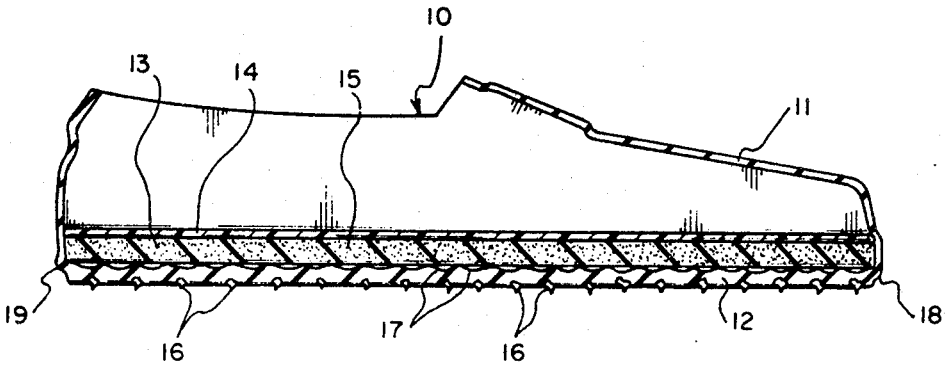
FIG. 3 is a cross-sectional view along lines 3—3 of FIG. 1.
Figure 4:
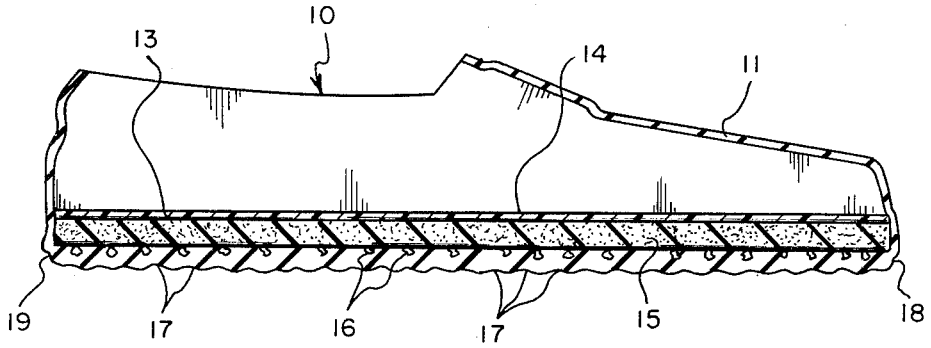
FIG. 4 is a cross-sectional view along lines 3—3 of the footwear shown in FIG. 1, except that it has been turned inside out and the inner sole shown in FIG. 2 reinserted.
Figure 5:
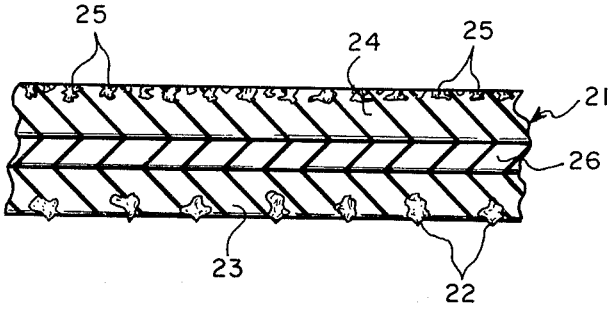
FIG. 5 is an expanded cross-sectional view of an alternative construction of the sole portion of the shoe boot illustrated in FIG. 3.
Figure 6:
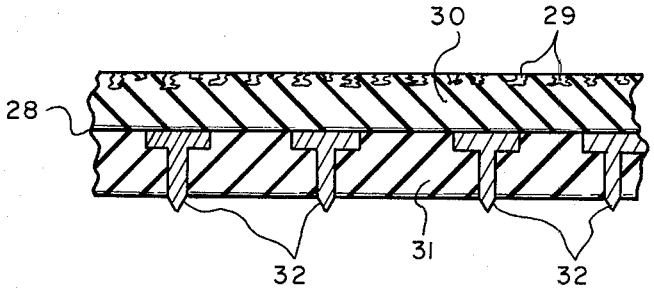
FIG. 6 is an expanded cross-sectional view of an alternative construction of the sole portion of the footwear of FIG. 3.

In FIG. 1, convertible rubber footwear 10 is shown with shoe boot 11 having sole 12. Shoe boot 11 is molded of black synthetic rubber having substantial elasticity of a size that it stretches over and holds over a shoe. Inner sole 13 is shown in place inside shoe boot 11 in FIG. 1 and is shown separate in FIG. 2. Inner sole 13 is constructed of semi-rigid plasticized polyvinyl chloride sheet 14 adhesively adhered to foam rubber sheet 15. Inner sole 13 may be constructed of a number of combinations of materials. For example, sheet 14 is chosen to hold the interior shape of the sole and resist wear against the shoe sole and heal worn inside boot 11. Suitable materials are leather, semi-rigid polymer plastics and composition paperboard. Semi-rigid polymer is preferred. Sheet 15 is chosen to be a nondestructive surface when it is abutted against the abrasion side of the sole of shoe boot 11. Suitable materials include foam rubber, fiber mat, and softened leather, foamed elastomer or rubber is preferred. Inner sole 13 may be a composite as pictured in FIG. 2 or it may be a single composition possibly with differing treatments to opposite sides, carefully chosen to satisfy both criteria such as leather. Without inner sole 13 present, the bottom of the shoe inside boot 11 would quickly dislodge and wear away the abrasion imbedments in sole 12. The relative thickness of inner sole 13 in fact, all of the thicknesses of the various walls, are expanded for clarity and are not necessarily proportional. Sheet 14 is 35 mils thick while foam sheet 15 is 150 mils thick. In FIG. 3, a cross-sectional view of rubber footwear 10 is illustrated with inner sole 13 in place. Again for illustration, sole 12 is shown thicker than it is. Its 100 mil thickness is approximately twice as thick as the wall of boot 11. Rock particulate 16 broken with sharp edges protruding from the bottom surface of sole 12. Rock particulate 16 abrades ice and provides good slip resistance. On the other side of sole 12, shown in this FIG. 3 on the inside, is molded pattern 17 which provides improved slip resistance on wet surfaces. In this configuration, particulate 16 provides excellent slip resistance on ice, but would wear out rapidly if used while walking on cement or asphalt. The particulate would remain imbedded in the rubber for only a short time, would soon drop off, and its effect lost. Toe end 18 and heel end 19 are each designed so that when shoe boot 11 is turned inside out the end shapes allow the boot to take on essentially the same shape. In FIG. 4, rubber footwear 10 is shown after inner sole 13 has been removed. Shoe boot 11 has been turned inside out leaving pattern 17 on the bottom for wet surfaces. Inner sole 13 has been reinserted in boot 11 to protect particulate 16 from being abraded off by the shoe heel and sole. Foam 15 is placed against the rock particulate with sheet 14 against the shoe sole. In FIG. 5 another construction of sole 21 is provided with a sandwich of rock particulate 22 in rubber coating 23 on one side and rubber 24 with cavities 25 on the other side, both sandwiching inner sheet 26. Cavities 25 are formed by adhering rubber 24 with soluable or easily removable organic particulate ingrained in the coating. Upon exposure to water or wear, the ingrained material is removed leaving voids which improve the wet slip resistance. In FIG. 6 another alternative sole construction 28 is illustrated with cavities 29 imbedded in rubber sheet 30 providing the wet slip resistance adhesively backed against rubber sheet 31 in which metal studs 32 are imbedded. In this construction, metal studs 32 are quite durable when used only on ice but would be readily worn or torn out in continuous usage on merely wet pavement.

While my invention is described with particularity as to material, shape and size, it should be understood that the specifics are not critical to this invention. The patent is intended to include modification and changes which may come within and extend from the following claims.

I claim:

1. Convertible rubber footwear comprising:

(a) a reversible shoe boot with a sole portion having two surfaces, wherein the shoe boot turned inside out forms essentially the same shape, wherein the first surface has imbedded therein an abrasion means which will essentially prevent sliding on ice, and wherein the second surface is provided with a standard non-slip surface, and (b) an innersole of a shape to fit inside the shoe boot covering the inside of the sole portion, with the innersole having an upper surface of a semi-rigid material capable of holding the interior shape of the sole and a lower softer surface of a material that will not deteriorate the abrasion means.

2. The convertible rubber footwear of claim 1 wherein the first surface has sharp inorganic particulate imbedded in the surface to provide the abrasion means.

3. The convertible rubber footwear of claim 1 wherein the second surface has a pattern molded in rubber to reduce slipping on wet surfaces.

4. The convertible rubber footwear of claim 1 wherein the first surface has sharpened metal studs imbedded in the surface rubber.

5. The convertible rubber footwear of claim 1 wherein the innersole is a semirigid plastic sheet bonded to a soft resilient polymer foam.

* * * * *